US009926751B2

(12) United States Patent
Hafernik et al.

(10) Patent No.: US 9,926,751 B2
(45) Date of Patent: Mar. 27, 2018

(54) ENHANCED RAM-STYLE RISER TENSIONER

(71) Applicant: Dril-Quip, Inc., Houston, TX (US)

(72) Inventors: Steven M. Hafernik, Houston, TX (US); Fife B. Ellis, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 5 days.

(21) Appl. No.: 14/946,437

(22) Filed: Nov. 19, 2015

(65) Prior Publication Data

US 2016/0145952 A1 May 26, 2016

Related U.S. Application Data

(60) Provisional application No. 62/082,998, filed on Nov. 21, 2014.

(51) Int. Cl.

| | |
|---|---|
| ***E21B 17/01*** | (2006.01) |
| ***E21B 19/09*** | (2006.01) |
| ***E21B 19/00*** | (2006.01) |
| ***F15B 1/04*** | (2006.01) |

(52) U.S. Cl.
CPC ..... *E21B 19/006* (2013.01); *F15B 1/04* (2013.01)

(58) Field of Classification Search
None
See application file for complete search history.

(56) References Cited

U.S. PATENT DOCUMENTS

| | | | | |
|---|---|---|---|---|
| 7,008,340 | B2 * | 3/2006 | Williams | E21B 19/006 166/355 |
| 7,329,070 | B1 | 2/2008 | Trent et al. | |
| 7,632,044 | B2 | 12/2009 | Pallini et al. | |
| 7,988,385 | B2 | 8/2011 | Pallini et al. | |
| 8,011,858 | B2 | 9/2011 | Pallini et al. | |
| 8,123,438 | B2 | 2/2012 | Pallini et al. | |
| 8,517,109 | B2 * | 8/2013 | Trent | B63B 35/44 166/352 |
| 8,657,536 | B2 * | 2/2014 | Koos | E21B 19/006 166/355 |
| 9,476,264 | B2 * | 10/2016 | Plain | E21B 19/006 |
| 2005/0074296 | A1 * | 4/2005 | McCarty | E21B 19/006 405/224.4 |

(Continued)

FOREIGN PATENT DOCUMENTS

WO 2011133552 A1 10/2011

OTHER PUBLICATIONS

Search Report issued in related UK patent application No. GB15204365, dated Dec. 24, 2015, (3 pages).

*Primary Examiner* — Matthew R Buck
*Assistant Examiner* — Douglas S Wood
(74) *Attorney, Agent, or Firm* — Baker Botts L.L.P.

(57) ABSTRACT

In accordance with embodiments of the present disclosure, a ram-style riser tensioner system includes a plurality of cylinders for applying a desired tension to a riser, a support structure coupled to the riser, and a plurality of gas accumulators. Each of the cylinders is coupled to the support structure, and each of the gas accumulators is configured to provide pressurized gas to a corresponding one of the cylinders. The ram-style riser tensioner also includes a plurality of support rods coupled to the support structure for reducing bending moments on the plurality of cylinders.

17 Claims, 4 Drawing Sheets

(56) References Cited

U.S. PATENT DOCUMENTS

2005/0129464 A1* 6/2005 Moncus ..... E21B 19/006
405/203
2007/0074296 A1* 3/2007 Ashkenazi ..... C07K 14/70578
800/14

* cited by examiner

ENHANCED RAM-STYLE RISER TENSIONER

CROSS-REFERENCE TO RELATED APPLICATIONS

The present application is a non-provisional patent application of U.S. provisional application Ser. No. 62/082,998, entitled "Enhanced Ram-Style Riser Tensioner", filed on Nov. 21, 2014.

TECHNICAL FIELD

The present disclosure relates generally to riser tensioners for use on floating platforms and, more particularly, to an enhanced ram style riser tensioner.

BACKGROUND

Various types of riser tensioners have been devised for use in the oil and gas industry. These tensioners help to maintain a desired tension on a riser extending between a subsea oil well and a surface (e.g., floating) platform. Ram-style riser tensioners are often used to provide tension to risers used in spar and tension leg platform (TLP) applications. Ram-style riser tensioners may also be used in dry tree semi-submersible applications. Ram-style tensioners include hydro-pneumatic cylinders used to maintain a nearly constant tension on production risers or drilling risers as the floating platform moves in the ocean due to waves, current, and other factors.

In conventional ram-style tensioners, the cylinders are exposed to a variety of different loading conditions. Unfortunately, traditional ram-style tensioners can have difficulty resisting bending loads that may be imparted to the hydro-pneumatic cylinders of the tensioners. For example, tensioner systems are typically designed so that if one cylinder fails, the remaining cylinders are able to maintain a desired tension in the riser. However, during this scenario, large bending moments can be applied to the riser due to the imbalance in the tension load being supported by the remaining cylinders. In addition, the cylinders can be exposed to compression due to movements occurring on the platform. In some instances, the ram-style tensioners can be exposed to torsion, where the direction of the cylinder force tends to add to the torsional loading rather than resisting it.

To address these different loading conditions and to protect the riser from bending, existing tensioners often include complex structures for guiding the riser while reducing the bending force on the cylinders. Unfortunately, these structures can be bulky and may reduce operator access to surface wellhead and tree equipment.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to an enhanced ram-style riser tensioner system. In accordance with embodiments of the present disclosure, the ram-style riser tensioner system includes a plurality of cylinders for applying a desired tension to a riser, a support structure coupled to the riser, and a plurality of gas accumulators. Each of the cylinders is coupled to the support structure, and each of the gas accumulators may be internal to a corresponding one of the cylinders to provide pressurized gas to the cylinders. The ram-style riser tensioner also includes a plurality of support rods coupled to the support structure for reducing bending moments on the plurality of cylinders.

In some embodiments, the cylinders of the riser tensioner are coupled to a floating platform at a single connection point. In some embodiments, the riser tensioner includes a plurality of external gas accumulators for providing an additional volume of gas to the cylinders during stroke operation. The support rods may be coupled to the support structure at positions that are disposed radially outward from the riser, and the cylinders may be coupled to the support structure at positions disposed between the support rods. This arrangement may reduce the overall bending moment experienced by the cylinders.

Figure 1:
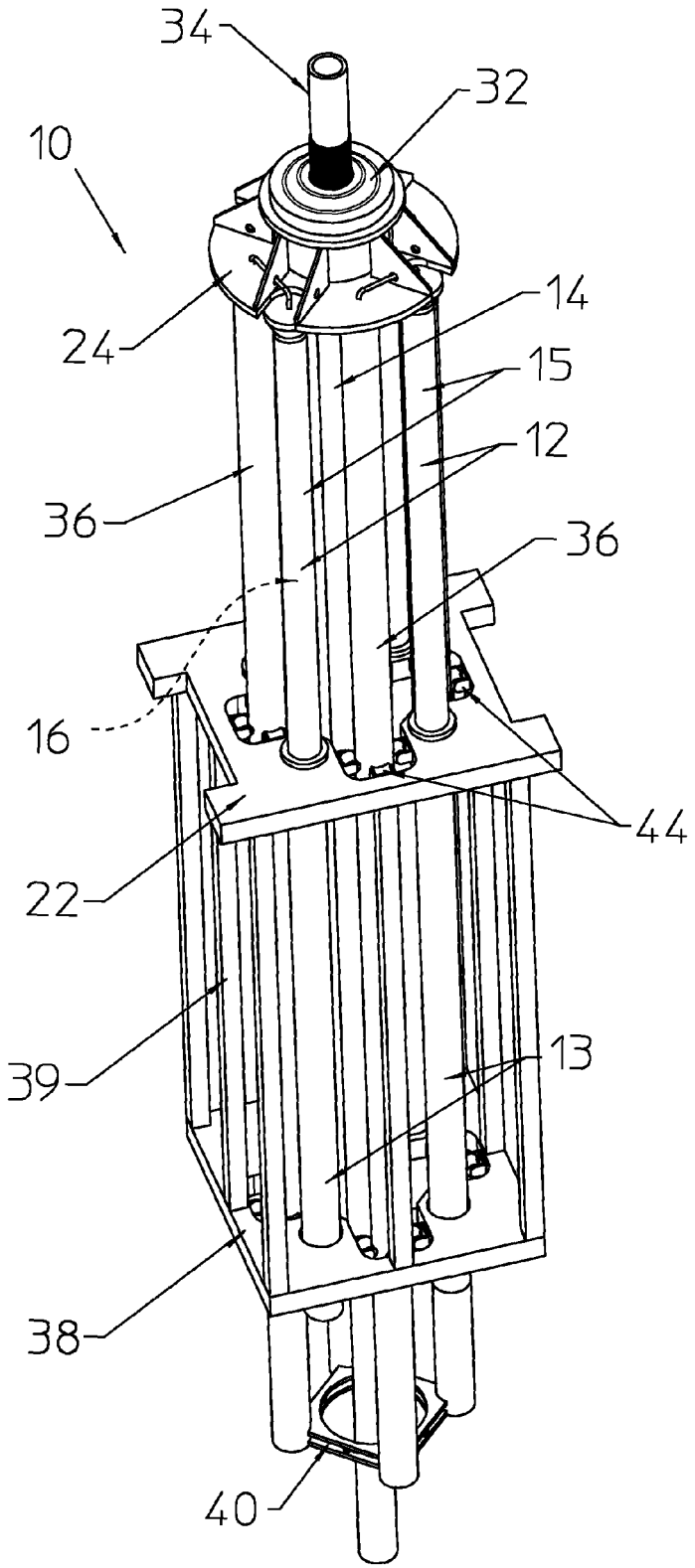
FIG. 1 is a perspective view of a ram-style riser tensioner, in accordance with an embodiment of the present disclosure.

Turning now to the drawings, FIG. 1 illustrates a ram-style tensioner 10 that uses a plurality of hydro-pneumatic cylinders 12 to maintain a desired tension on a riser 14. The riser 14 may generally be coupled between a floating platform and a subsea well device. Each cylinder 12 may include a barrel portion 13 and a rod portion 15 disposed partially in the barrel portion 13. The rod portion 15 is designed to be stroked relative to the barrel portion 13 to lengthen or compress the cylinder 12 in response to movement of the floating platform relative to the subsea well device.

Figure 5:
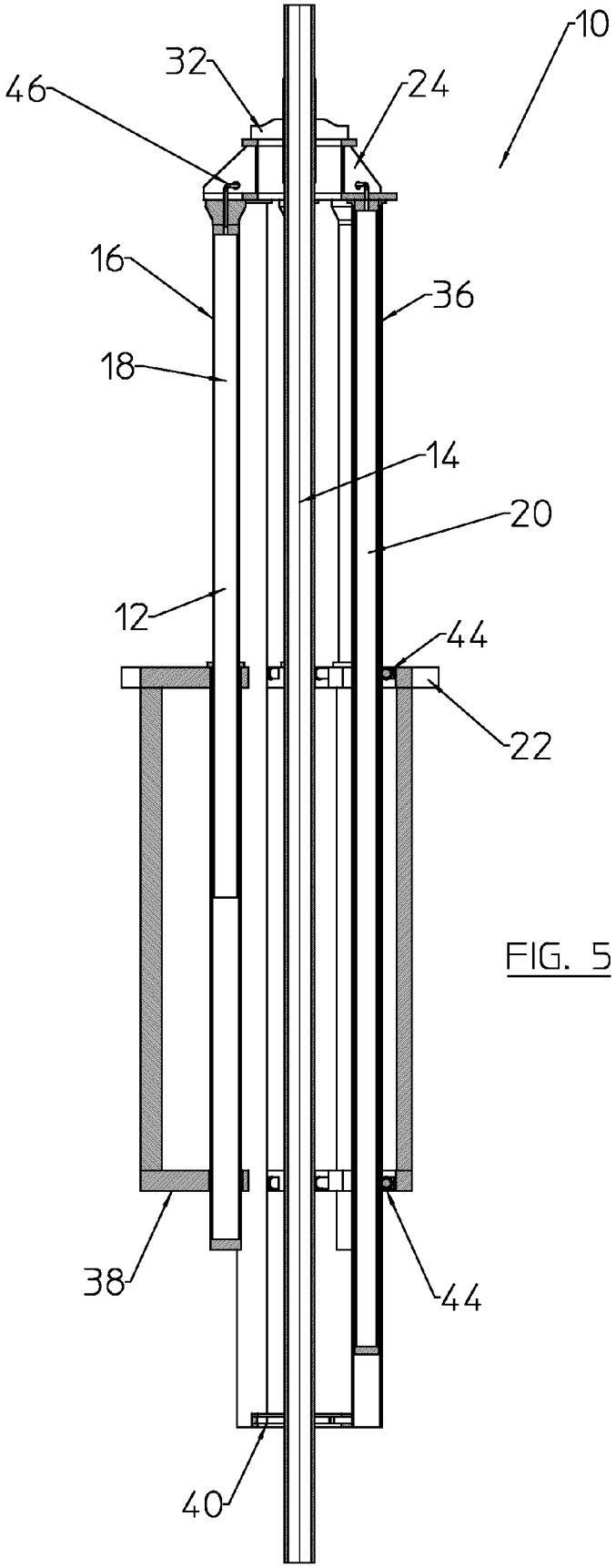
FIG. 5 is a cross sectional view taken along lines C-C of the ram-style riser tensioner of FIG. 3, in accordance with an embodiment of the present disclosure.

The tensioner 10 may include a plurality of gas accumulators 16 to provide a desired amount of gas for maintaining a desired tension on the riser 14 as the cylinders 12 are stroked. As illustrated in FIG. 5, the primary gas accumulators 16 may be internal accumulators disposed within the hollow barrel portion 13 and/or rod portion 15 of the cylinder 12. Each cylinder 12 may be maintained in a certain range of tensions by appropriately sizing the corresponding gas accumulator 16. This sizing of the accumulator 16 may be determined based on a desired stroke and stiffness for the cylinder 12.

In some embodiments, the amount of pressurized gas needed to maintain the tension in the riser 14 as the cylinder 12 strokes may exceed the volume available in the internal accumulator 16 of the cylinder 12. Thus, the tensioner 10 may include an external accumulator 20 for each cylinder 12 that is manifolded to the appropriate cylinder 12 to provide the desired gas volume.

The ram-style tensioner 10 is generally coupled to a floating platform (not shown) where drilling and production operations are performed. As the floating platform moves in response to waves, current, and other factors, the cylinders 12 of the tensioner 10 lengthen or compress while maintaining a desired tension on the riser 14. In some embodiments, the cylinders 12 may be mounted either directly into the hull of the floating platform, or to a structural frame 22 that mounts to the hull. As illustrated in FIG. 1, the barrel portion 13 of the cylinder 12 may be coupled to the structural frame 22, while the rod portion 15 is allowed to stroke up and down to move the riser 14 relative to the structural frame 22.

Figure 2:
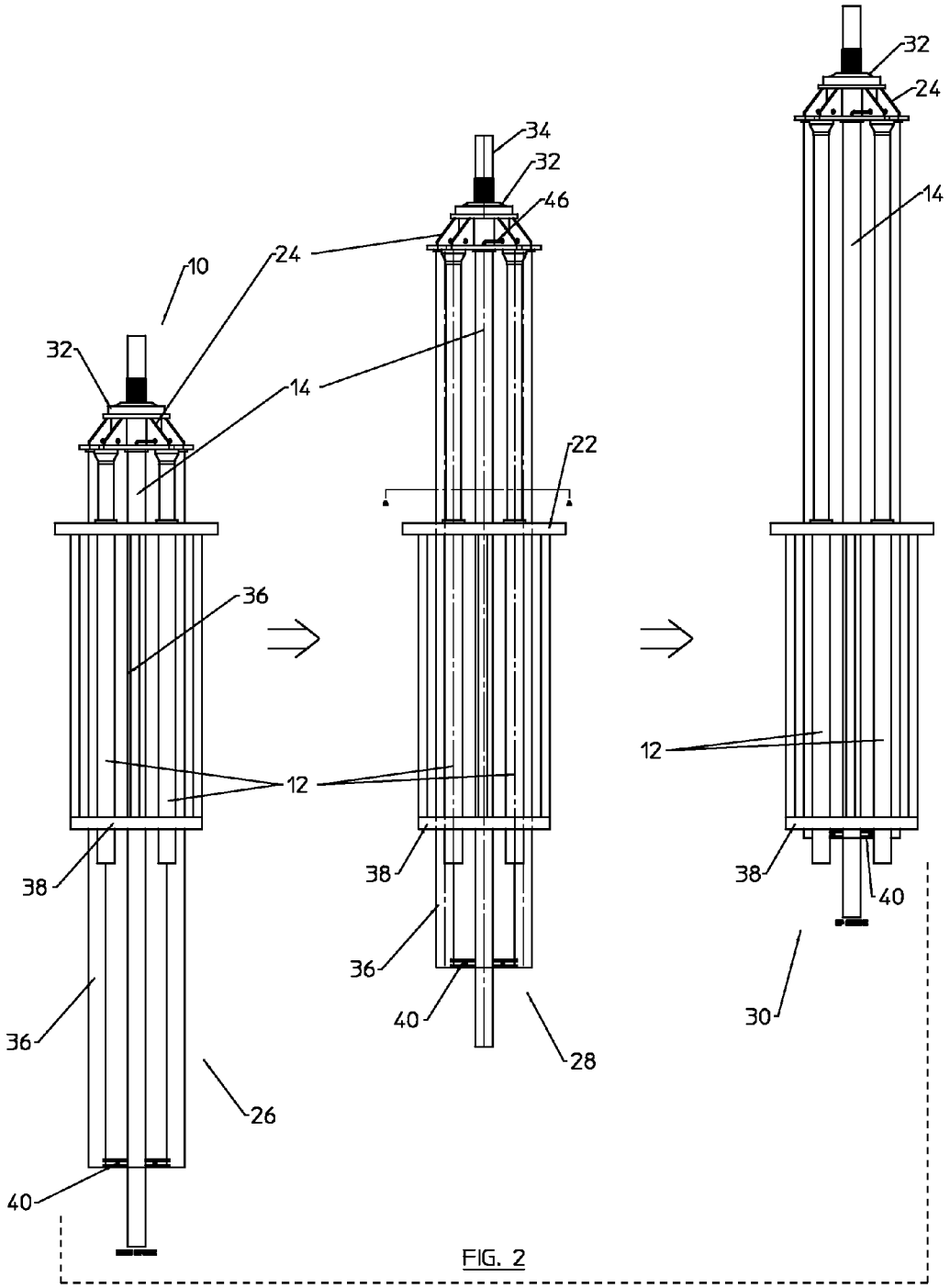
FIG. 2 is a front view of the ram-style riser tensioner of FIG. 1 being stroked from a down stroke position to an up stroke position, in accordance with an embodiment of the present disclosure.

The tensioner 10 may include an upper structure 24 that is mounted to the rod portion 15 of each cylinder 12. The upper structure 24 may move up and down as the cylinders 12 are stroked. This stroking motion of the tensioner 10 is illustrated in FIG. 2. For example, the upper structure 24 may stroke from a down stroke position 26 to a null position 28 and to an up stroke position 30. The upper structure 24 may serve as an interface for a riser tensioner ring 32 that is fixed to the riser 14 at a tension joint 34. This enables the upper structure 24 to move the riser 14 up and down relative to a moving platform via the stroking cylinders 12, in order to maintain the desired tension on the riser 14.

In some embodiments, the tensioner 10 may include a plurality of support rods 36 designed to provide structural support to reduce bending moments and torsional loads that would otherwise be transferred to the cylinders 12. The support rods 36 may be connected to the upper structure 24 and designed to pass through a lower structure 38. As illustrated, in some embodiments the lower structure 38 may be coupled (e.g., via support bars 39) to the structural frame 22. A lower support ring 40 may secure the support rods 36 below the lower structure 38, and the riser 14 may pass through a center of the lower support ring 40. The support rods 36 may be fixed at the top to the upper structure 24 and at the bottom to the lower support ring 40.

Figure 3:
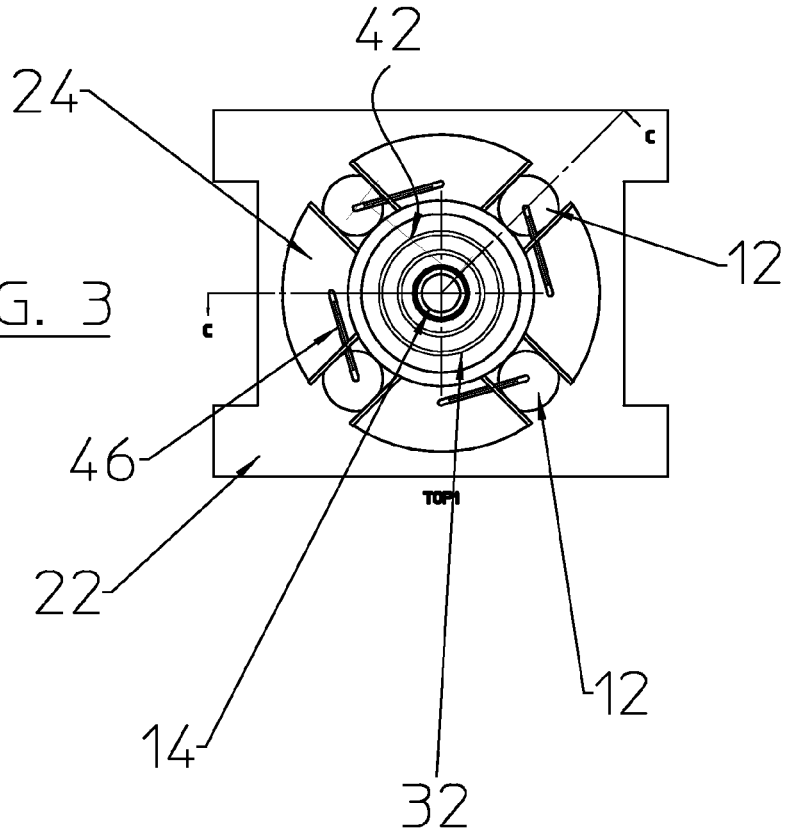
FIG. 3 is a top view of the ram-style riser tensioner of FIG. 1, in accordance with an embodiment of the present disclosure.
Figure 4:
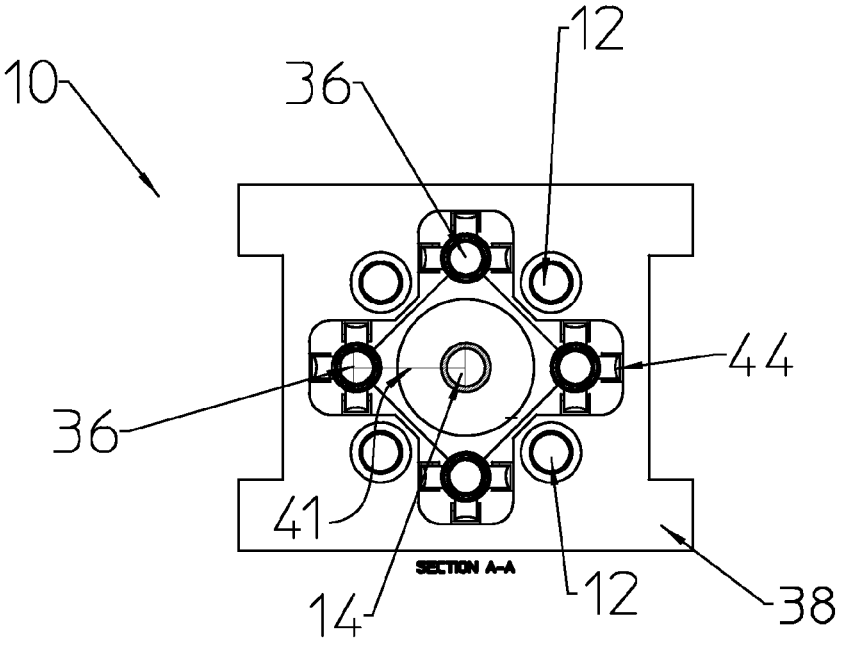
FIG. 4 is a section view taken along the lines A-A of the ram-style riser tensioner of FIG. 2, in accordance with an embodiment of the present disclosure.

The support rods 36 may be fixed to the upper structure 24 such that they are radially spaced a certain distance 41 from the riser 14, as shown in FIG. 4. This distance 41 may be far enough for the support rods 36 to have an effective section modulus capable of resisting any bending moments or torsional loads that could otherwise be transferred into the cylinders 12. As shown in FIGS. 3 and 4, the cylinders 12 may be fixed to the upper structure 24 at positions located between the support rods 36. Thus, the cylinders 12 may be radially spaced by a relatively minimal distance 42 from the riser 14.

The support rods 36 may engage the structural frame 22 (and the lower structure 38) via a sliding or rolling interface 44 to transfer any bending and torsional loads through the structural frame 22 and back to the main deck of the platform, as shown in FIGS. 1, 4, and 5. As the cylinders 12 stroke up and down, the support rods 36 may move axially through the structural frame 22 and the support structure 38, as shown in FIG. 2.

In some embodiments, the external accumulators 20 may be mounted inside the support rods 36 as shown in FIG. 5, such that the support rods 36 also serve as the external accumulators 20. Plumbing between the cylinders 12 and the corresponding external accumulators 20 may be run through the upper structure 24. Although illustrated as having four cylinders 12 and four support rods 36, it should be noted that any desirable number of cylinders 12 and corresponding support rods 36 may be used in other embodiments of the riser tensioner 10. For example, the tensioner 10 may include 4, 5, 6, 7, 8, 9, 10, or more of each of the cylinders 12 and support rods 36 to maintain the desired tension on the riser 14.

As mentioned above, the tensioner 10 may include a manifold 46 for routing gas from the external accumulators 20 in the support rods 36 to the appropriate cylinders 12. By attaching the accumulators 20 only at one end (top) of each support rod 36 in this manner, the accumulators 20 may be left free at the other end. This may facilitate expansion of the external accumulator 20 with additional pressure. In addition, this may leave the external accumulator 20 free from any external bending loads in the support rod 36.

The disclosed tensioner 10 may be installed as a single unit with only one interface point (e.g., structural frame 22, cylinders 12) between the tensioner 10 and the hull of the floating platform. This facilitates a relatively simple installation process for the present tensioner 10, as compared to traditional ram-style tensioner designs that often require a connection point for the frame and an additional interface point for resisting loads on the cylinders. Unlike many conventional tensioners, the disclosed tensioner 10 does not utilize an additional support attached directly to the riser 14. This allows the tensioner 10 to limit the impact of certain external forces on the riser 14.

Still further, existing tensioners often utilize guideposts positioned between the upper and lower decks on the floating platform, thereby limiting access to the surface wellhead equipment and tree equipment for the well. However, the presently disclosed tensioner 10 avoids these access limitations by having only the one interface point at the structural frame 22 and/or lower structure 38 (or directly at the cylinders 12). This less complicated tensioner 10 with improved access may ease design restraints on the surface equipment being attached to the end of the riser 14.

As discussed above with reference to FIGS. 3 and 4, present embodiments of the tensioner 10 may facilitate the placement of the cylinders 12 into a position that is relatively close (e.g., within distance 42) to the riser 14. In traditional designs, the cylinders are generally spaced radially outward from a central conductor placed around the riser. The central conductor is often used to oppose bending forces, and therefore is sized to be large enough to resist the bending moments. However, in the disclosed embodiment, the tensioner 10 utilizes the support rods 36 instead of a central conductor. This arrangement enables the support rods 36 to be placed between the cylinders 12, thereby allowing the cylinders 12 to be located radially closer to the riser 14. This closer positioning of the cylinders 12 may reduce the overall bending moment on the system, as well as the footprint of the tensioner 10.

Although the present disclosure and its advantages have been described in detail, it should be understood that various changes, substitutions and alterations can be made herein without departing from the spirit and scope of the disclosure as defined by the following claims.

What is claimed is:

1. A ram-style riser tensioner system, comprising:

a plurality of cylinders, wherein each of the plurality of cylinders comprises a barrel portion, a rod portion disposed at least partially within the barrel portion, and an internal gas accumulator for maintaining a desired tension on a riser as the cylinder strokes the rod portion relative to the barrel portion;

a upper structure coupled to the riser, wherein each of the plurality of cylinders is coupled to the upper structure;

a plurality of support rods coupled to the upper structure for reducing bending moments and/or torsional loads on the plurality of cylinders;

a structural frame configured to be mounted to a hull of a floating platform, wherein the plurality of cylinders are coupled to the structural frame, wherein the structural frame is a single connection point between the ram-style tensioner system and the floating platform, and wherein the structural frame is configured to transfer the bending moments and/or torsional loads from the plurality of cylinders to the plurality of support rods; and a plurality of external gas accumulators, wherein each external gas accumulator is fluidly coupled to and configured to provide an additional volume of gas to the internal gas accumulator in a corresponding one of the plurality of cylinders, wherein each external gas accumulator is disposed within a corresponding one of the plurality of support rods.

2. The ram-style riser tensioner system of claim 1, further comprising a rolling or sliding interface for engaging the support rods extending through apertures in the structural frame of the ram-style tensioner system, the rolling or sliding interface formed directly between and slidably coupling the support rods to the structural frame.

3. The ram-style riser tensioner system of claim 1, wherein the plurality of support rods are each coupled to the upper structure at positions that are disposed radially outward from the riser.

4. The ram-style riser tensioner system of claim 3, wherein the plurality of cylinders are coupled to the upper structure at positions that are disposed radially outward from the riser and disposed between adjacent support rods such that the cylinders and support rods are arranged in an alternating pattern circumferentially around the riser.

5. The ram-style riser tensioner system of claim 1, wherein the upper structure comprises a manifold for routing gas from the plurality of external gas accumulators to the corresponding plurality of cylinders.

6. The ram-style riser tensioner system of claim 1, wherein the upper structure comprises an upper structure coupled to the top of the plurality of cylinders.

7. The ram-style riser tensioner system of claim 1, further comprising a tension ring fixed to the riser at a tension joint, wherein the tension ring is coupled to the upper structure.

8. The ram-style riser tensioner system of claim 1, further comprising a lower structure, wherein the plurality of support rods extend through apertures in the lower structure.

9. The ram-style riser tensioner system of claim 8, further comprising a rolling or sliding interface on the lower structure for engaging the support rods extending therethrough.

10. The ram-style riser tensioner system of claim 1, further comprising a lower support ring coupled to the plurality of support rods, wherein the lower support ring is disposed around the riser.

11. The ram-style riser tensioner system of claim 1, wherein the plurality of cylinders are directly coupled to the structural frame.

12. The ram-style riser tensioner system of claim 1, wherein the plurality of support rods are entirely separate components from the plurality of cylinders.

13. A method, comprising:

stroking a plurality of cylinders of a ram-style riser tensioner to move a riser relative to a floating platform, wherein each of the plurality of cylinders is coupled to a upper structure coupled to the riser, and wherein each of the plurality of cylinders comprises a barrel portion, a rod portion disposed at least partially within the barrel portion, and an internal gas accumulator;

maintaining a tension on the riser via the internal gas accumulators of the plurality of cylinders as each cylinder strokes the corresponding rod portion relative to the corresponding barrel portion;

transferring bending moments or torsional loads from the plurality of cylinders through a structural frame to a plurality of support rods coupled to the upper structure, wherein the structural frame is mounted to a hull of the floating platform, wherein the plurality of cylinders are coupled to the structural frame, and wherein the structural frame is a single connection point between the ram-style riser tensioner and the floating platform;

reducing bending moments or torsional loads on the plurality of cylinders via the plurality of support rods; and providing additional volumes of gas to the plurality of cylinders from a plurality of external gas accumulators, wherein each external gas accumulator is fluidly coupled to the internal gas accumulator in a corresponding one of the plurality of cylinders, wherein each external gas accumulator is disposed within a corresponding one of the plurality of support rods.

14. The method of claim 13, further comprising stroking the plurality of cylinders to move the upper structure, the riser, and the plurality of support rods relative to the structural frame, and moving the plurality of support rods through apertures in the structural frame via a rolling or sliding interface formed directly between and slidably coupling the plurality of support rods to the structural frame.

15. The method of claim 13, further comprising routing gas between each of the external accumulators and each of the corresponding internal accumulators via a manifold disposed on the upper structure.

16. The method of claim 13, wherein the plurality of support rods are each coupled to the support structure at positions that are disposed radially outward from the riser.

17. The method of claim 16, wherein the plurality of cylinders are coupled to the upper structure at positions that are disposed radially outward from the riser and disposed between adjacent support rods such that the cylinders and support rods are arranged in an alternating pattern circumferentially around the riser.

* * * * *